US006053593A

United States Patent [19]

Röck

[11] Patent Number: 6,053,593

[45] Date of Patent: Apr. 25, 2000

[54] DRAWER

[75] Inventor: Erich Röck, Höchst, Austria

[73] Assignee: Julius Blum Gesellschaft m.b.H., Höchst, Australia

[21] Appl. No.: 09/045,368

[22] Filed: Mar. 20, 1998

[30] Foreign Application Priority Data

Mar. 21, 1997 [AT] Austria ..... 494/97

[51] Int. Cl.[7] ..... A47B 88/00

[52] U.S. Cl. ..... 312/348.2; 312/330.1

[58] Field of Search ..... 312/348.1, 348.2, 312/348.4, 330.1, 349, 263; 403/326, 329

[56] References Cited

U.S. PATENT DOCUMENTS

| | | | |
|---|---|---|---|
| 5,181,772 | 1/1993 | Albiez | 312/348.2 X |
| 5,458,413 | 10/1995 | Huber et al. | 312/348.2 X |
| 5,466,061 | 11/1995 | Lautenschlager | 312/348.2 |
| 5,611,637 | 3/1997 | Brustle et al. | 312/348.4 X |

FOREIGN PATENT DOCUMENTS

| | | | |
|---|---|---|---|
| 355 756 | 3/1980 | Austria . | |
| 382 071 | 1/1987 | Austria . | |
| 551575 | 7/1993 | European Pat. Off. | 312/348.2 |
| 3537335 | 4/1987 | Germany | 312/348.2 |
| 3601679 | 7/1987 | Germany | 312/348.2 |
| 36 09 621 | 9/1987 | Germany . | |
| 2087715 | 6/1982 | United Kingdom | 312/348.1 |

*Primary Examiner*—Peter M. Cuomo
*Assistant Examiner*—James O. Hansen
*Attorney, Agent, or Firm*—Wenderoth, Lind & Ponack, L.L.P.

[57] ABSTRACT

A drawer includes two double-walled drawer frame members, in which respective profile elements of plastic material are accommodated, which extend over the entire length of the drawer frame members. The profile elements either comprise separate front and rear subelements which have cover plates with which they adjoin the front and rear ends of the drawer frame members, or are provided with retaining elements such as slides or rockers, wherein the profile elements are anchored in the drawer frame members at the rear ends thereof.

17 Claims, 11 Drawing Sheets

13
15
14
1
25
24

14
13
25
24
16

14
24
15
24'

14
13
16
24

3
1
8'
23
15,16
8''

8'
3
1
23
8''
15,16

Fig. 13a
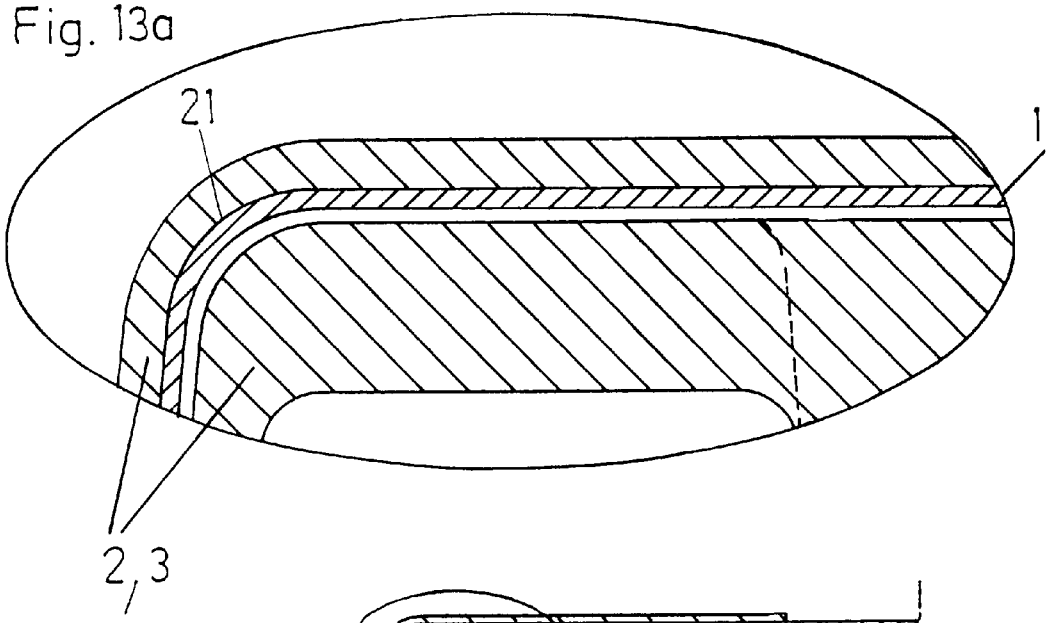
Fig. 13
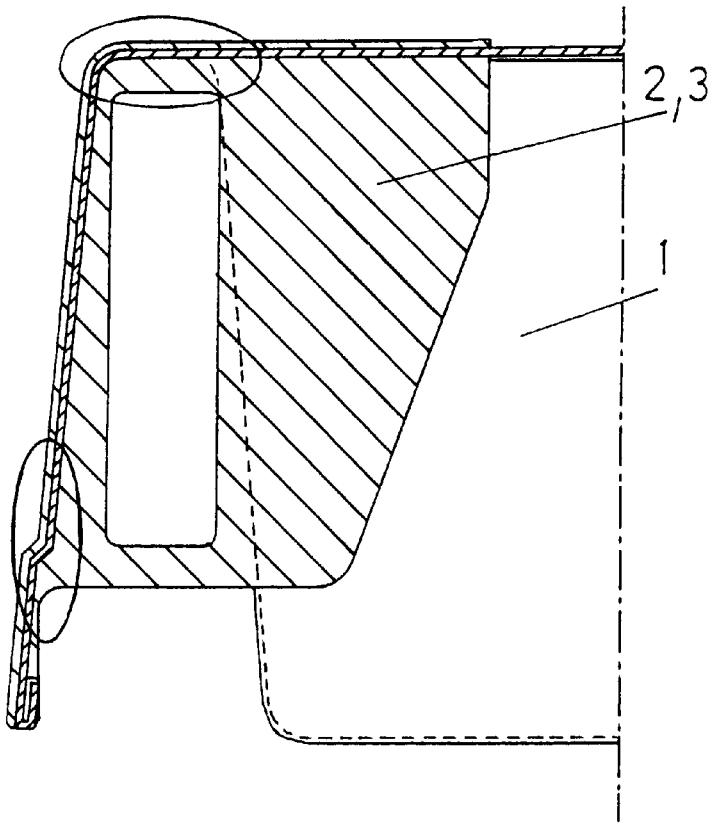
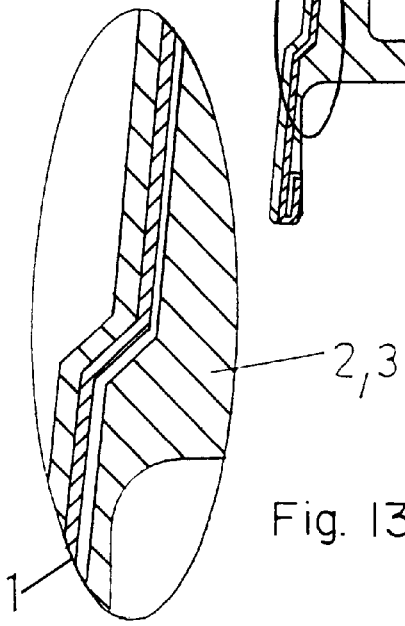
Fig. 13b

A
8
9
21
27
29
30
31
32
33
34
45

8
30
35
36
37
38
39
40
41
18
19
21

DRAWER

BACKGROUND OF THE INVENTION

1. Field of the Invention

The invention relates to drawer with two double-walled drawer frame members in which are accommodated profile elements of a plastics material to extend over the entire length of the drawer frame members.

2. Description of the Prior Art

A drawer of this type is known from AT 355 756 B. The drawer frame member of relatively thin material is stiffened by the inserted profile element, which contributes substantially to the stability of the drawer frame member. A drawer guide is advantageously partially incorporated in the profile element or anchored thereto. With such a drawer, it is also possible to anchor a front drawer panel to the profile elements.

SUMMARY OF THE INVENTION

Taking a basis a drawer of the above-mentioned type, the object of the invention is to improve retention of the profile elements in the drawer frame members in the drawer pull-out direction.

This object of the invention is achieved in that the profile elements have front cover plates, which adjoin the ends of the drawer frame members, and in that retaining elements are provided at the rear ends of the profile elements, which retaining elements are pushed onto the drawer frame members and anchored in the profile elements.

An advantageous exemplary embodiment of the invention provides that the profile elements comprise separate front and rear subelements which have front and rear cover plates, with which they adjoin the front and rear ends of the drawer frame members, and which may be coupled together by means of hooks or the like. The retaining elements are formed by the rear subelements together with the rear cover plates.

The profile element formed of the subelements thus extend over the entire length of each respective drawer frame member and project slightly therefrom at the ends. They rest at the front and back on the drawer frame members.

The drawer frame members may also be part of a trough, which forms the entire container space of the drawer. Trough and drawer frame members are, for example, made in one piece by injection-moulding of plastics material or by deep-drawing of sheet metal.

To improve stiffening of the drawer frame members or the troughs, an exemplary embodiment of the invention provides that the cover plates have grooves in which the ends of the drawer frame members are accommodated.

A further exemplary embodiment of the invention provides that the rear subelements are constructed with a hollow chamber, open at the top, for accommodating retaining pins for an elevated rear wail section of the drawer.

At least some of the hooks which couple the subelements are or resilient construction, such that it is sufficient to push the subelements inside one another to connect them together.

The subelements each advantageously have two hooks arranged one above the other and oriented in opposing directions. In order to provide improved retention for the outer walls of the drawer frame members, it is advantageous for the rear subelements to be provided with retaining elements which are displaceable or pivotable in a vertical plane and engage in a flange rim of the outer wall of the drawer frame members. The retaining elements advantageously take the form of slides or pivotable levers having inclined stop faces for the front subelements. In this embodiment, when the subelements are anchored together the slides or levers are pressed downwards into the flanged rim of the outer wall of the drawer frame member, and thus a firm connection is achieved between the drawer frame member and the profile element.

An exemplary embodiment of the invention provides that the retaining elements are formed of preferably wedge-shaped slides, which are inserted between the profile elements and the drawer frame members.

A further exemplary embodiment of the invention provides that the retaining elements take the form of rockers mounted rotatably on the profile elements.

BRIEF DESCRIPTION OF THE DRAWINGS

Various exemplary embodiments of the invention will be described below with reference to the attached drawings.

FIGS. 11*a*–12*b* are side views of coupling areas of the subelements, FIG. 13 is a cross section through a subelement in the area of cover plates, FIGS. 13*a*–13*b* are enlarged views of high-lighted portions of FIG. 13.

DESCRIPTION OF THE PREFERRED EMBODIMENTS

Figure 1:
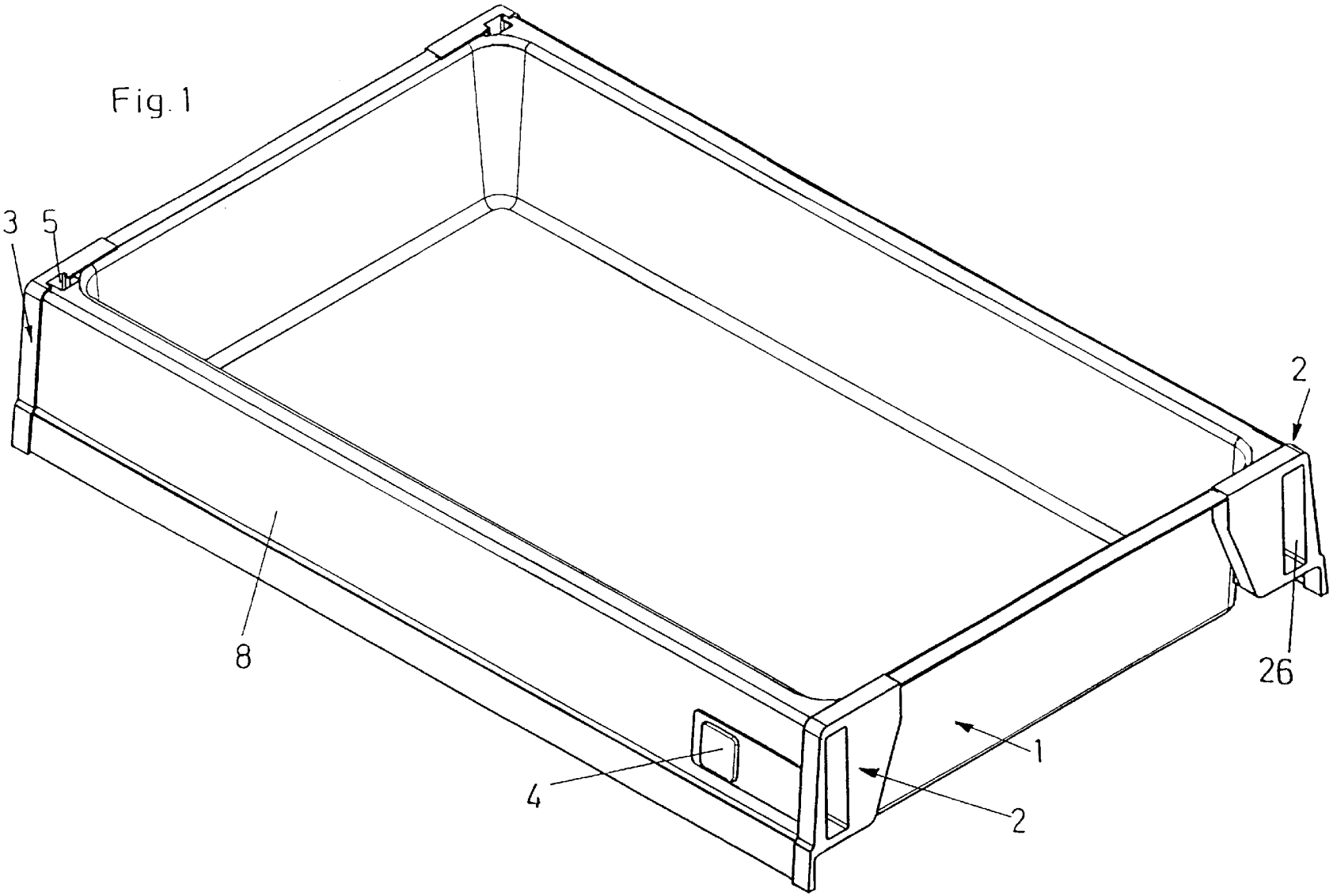
FIG. 1 is a perspective view of a drawer according to the invention.
Figure 2:
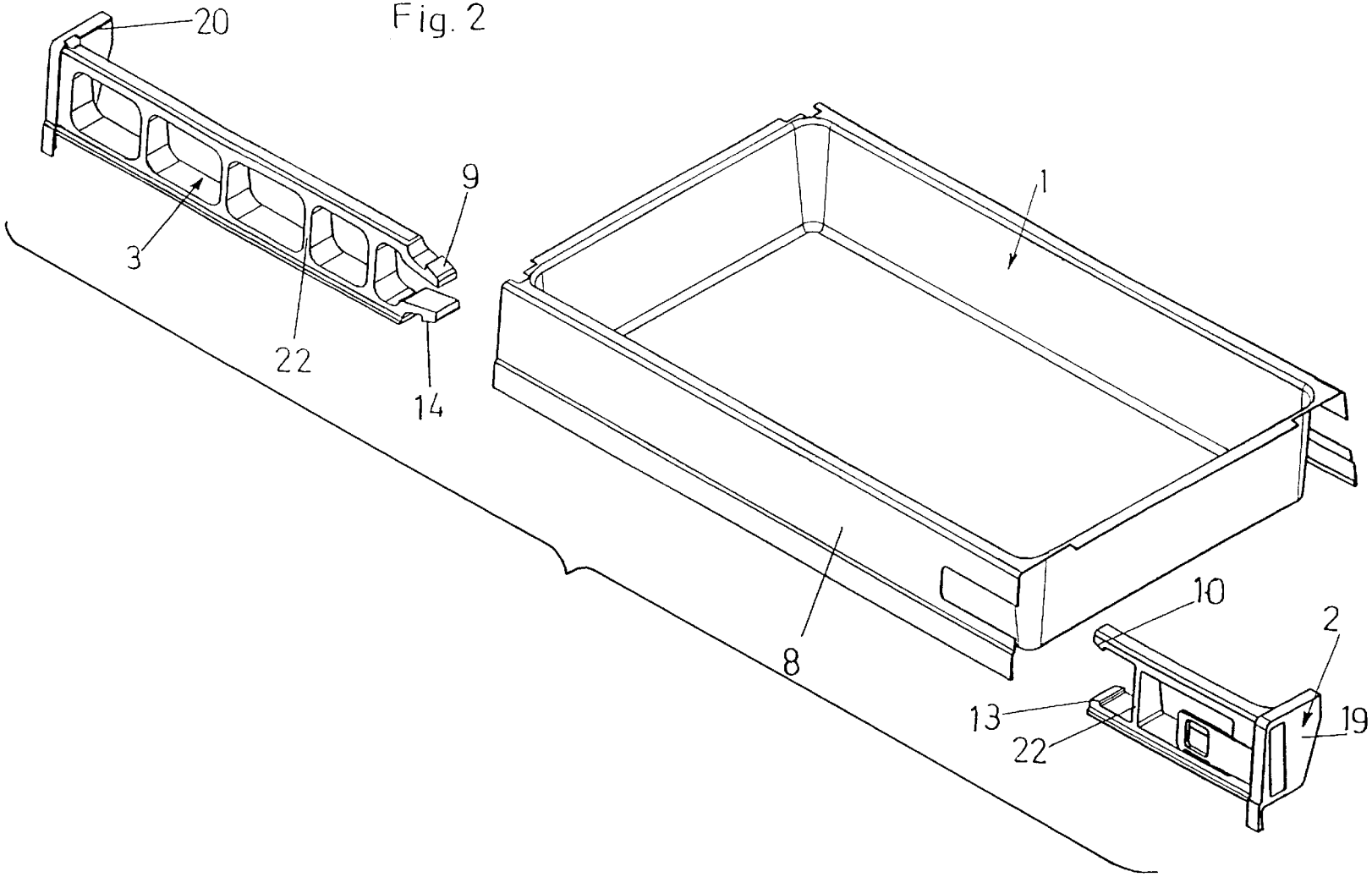
FIG. 2 is an exploded perspective view of a drawer according to the invention, in which subelements forming a profile element are shown withdrawn from a drawer frame member.

The drawer according to the invention essentially comprises a trough 1, of metal or plastic material, on which are formed drawer frame members 8. The drawer frame members 8 are constructed as hollow profiles, each with an inner wall 8' and an outer wall 8". Profile elements are inserted into the drawer frame members 8.

In the exemplary embodiment according to FIGS. 1 to 13, the profile elements comprise two subelements 2, 3. The subelements 2, 3, which are preferably formed from plastics profiles, have front and rear connecting plates 19, 20, which are provided on the insides with grooves 21 (FIG. 13), which accommodate the end edges of the drawer frame members 8 and thus contribute to further stiffening of the drawer frame members 8 or the trough 1.

The subelements 2, 3 further have vertical braces 22, which match the cross section of the drawer frame members 8 and stiffen drawer frame members 8.

The subelements 2, 3 are provided with hooks 9, 10 and 13, 14, by means of which the subelements 2, 3 are coupled together. The hooks 9, 10, 13, 14 are arranged one above the other, the hooks 10, 13 of the front subelement 2 being arranged facing each other, while the hooks 9, 14 of the rear subelement 3 are oriented in opposing directions.

In advantageous embodiments of the invention, a pivoting lever 15 (FIGS. 8, 8*b*, 11*a*, 11*b*) or a slide 16 (FIGS. 12*a*, 12*b*) is mounted on the rear subelement 3 below the lower hook 14. The pivoting lever 15 or the slide 16 projects downwards into a flanged rim 23 of the outer wall 8" of the drawer frame member 8. Both the pivoting lever 15 and the slide 16 are provided with oblique faces 24, 24', against which rests a mating surface 25 of the hook 13 of the front subelement 2. In this way, when the subelements 2, 3 are coupled together, the pivoting lever 15 or the slide 16 is pressed downwards into the flanged rim 23.

A chamber 26, open at the front, is constructed in the front subelement 2, in which chamber 26 there are arranged anchoring means 12 (FIG. 7) for a fixing means 11 of a front panel of the drawer (not shown). The front subelement 2 has a lateral opening, which provides screwdriver access to anchoring means 12. This opening is covered by a removable cap 4.

Figure 3:
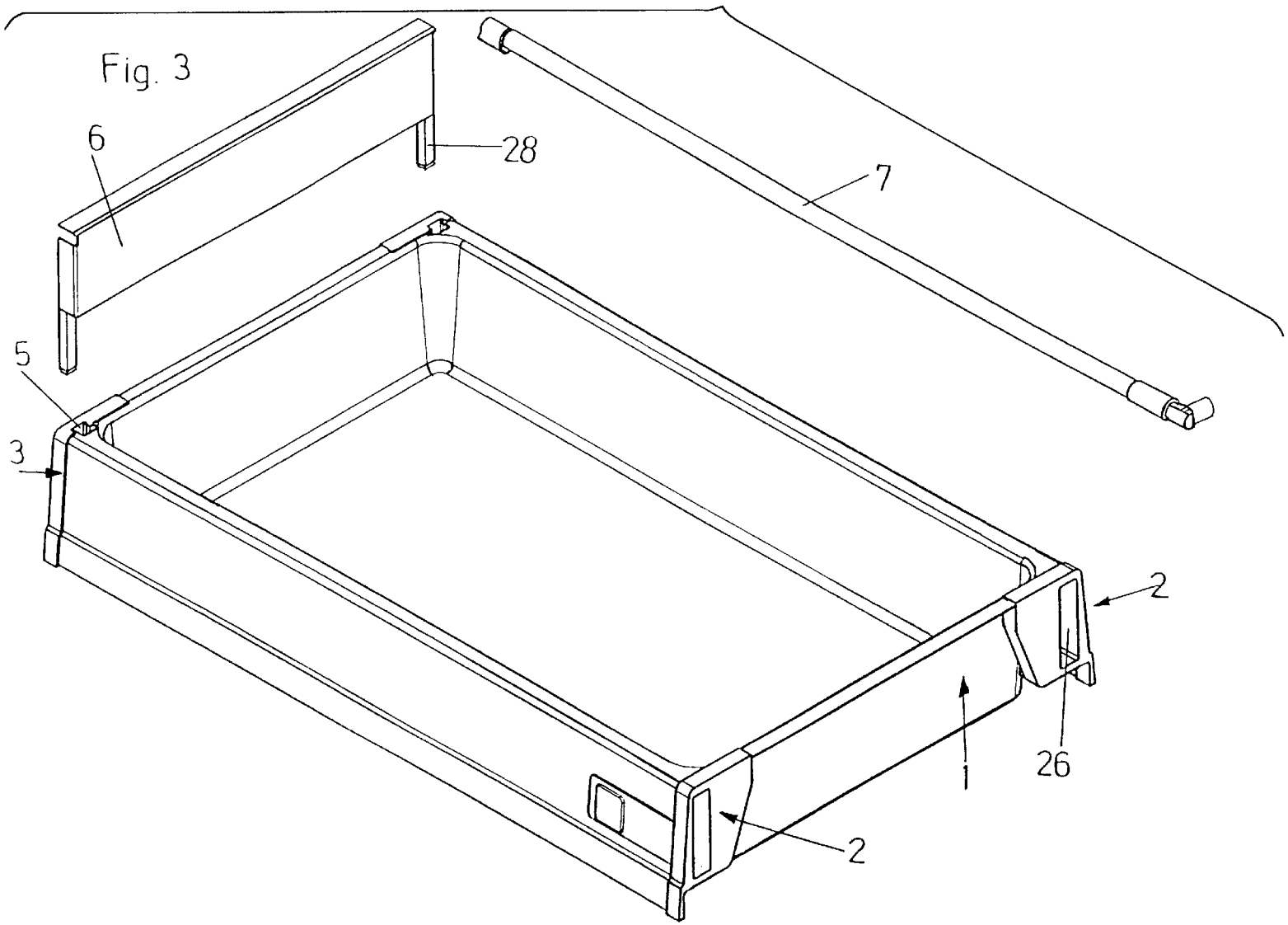
FIG. 3 is another exploded perspective view of a drawer according to the invention with an elevated rear wall section and a rail.

The rear subelements 3 have hollow chambers 5 open at the top, into which anchoring pins 28 of an elevated rear wall section 6 may be inserted (FIG. 3). Rails 7 may be attached in the conventional way to the elevated rear wall section 6.

The runner rails 17 (FIG. 8) of a drawer guide fitting are advantageously attached directly to the subelements 2, 3.

Figures 5, 6:
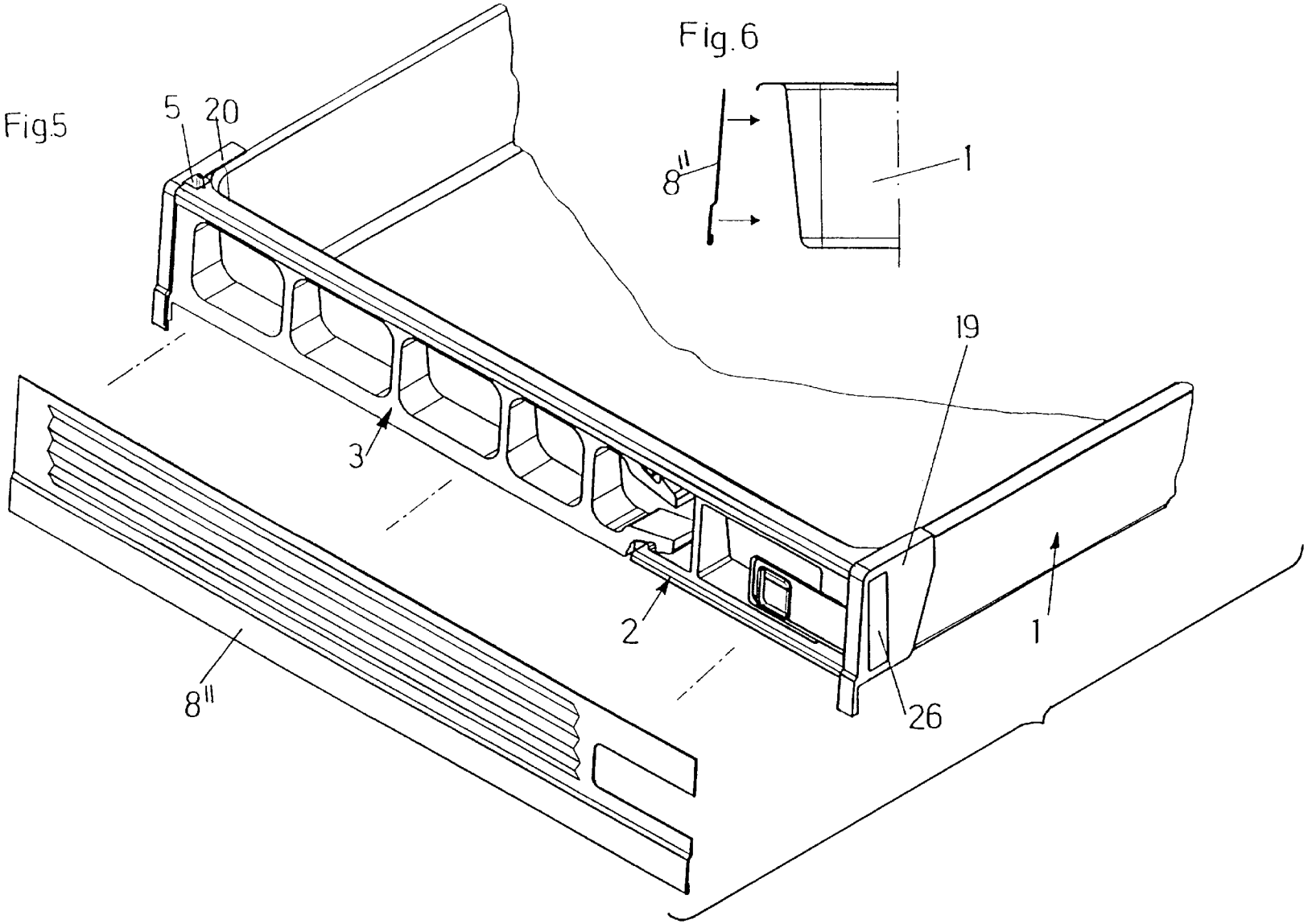
FIG. 5 is an exploded perspective view of a drawer frame member with an outer wall shown removed.
FIG. 6 is a schematic cross section of the drawer frame member according to FIG. 5.
Figure 7:
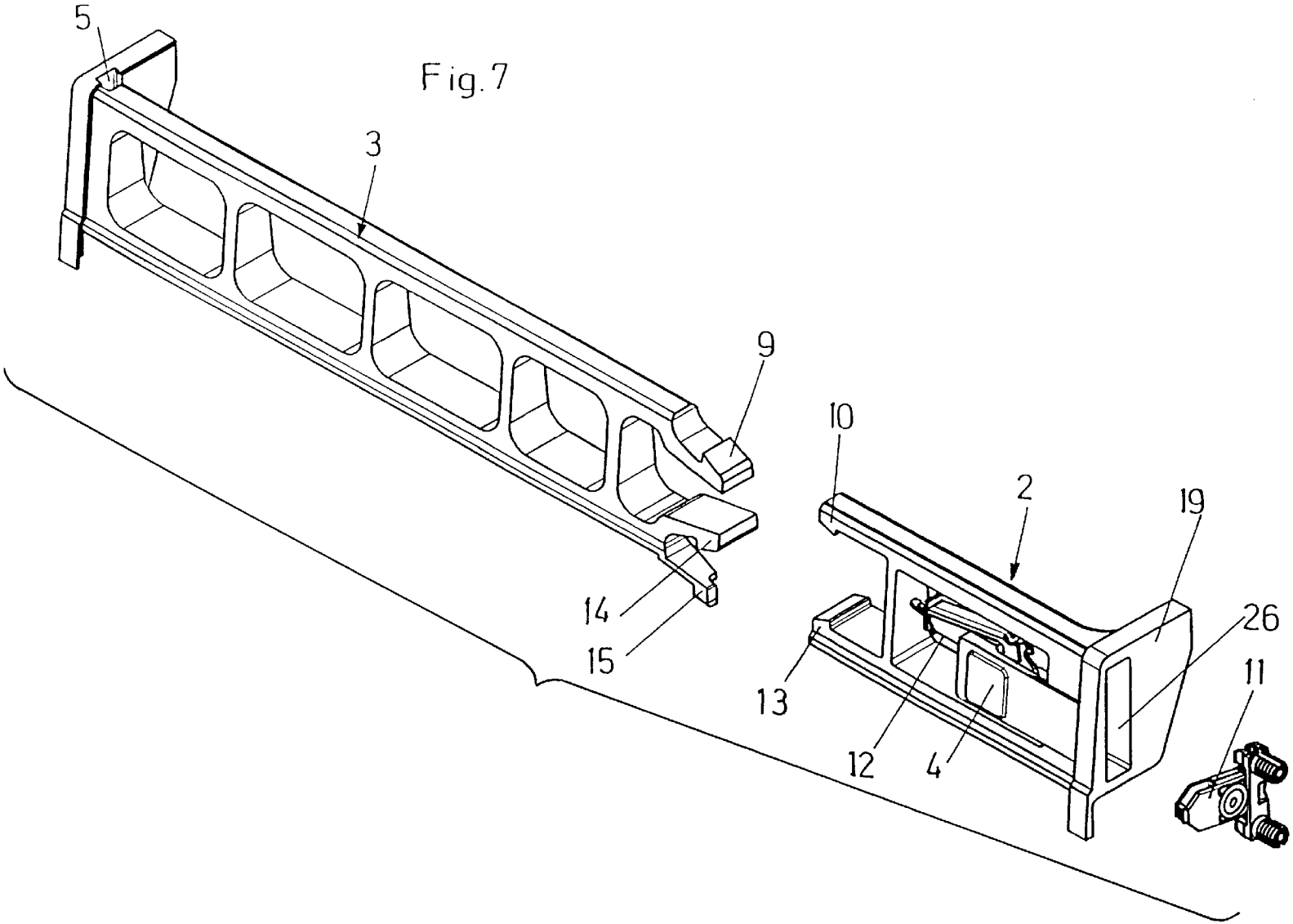
FIG. 7 is an exploded perspective view of two subelements and a fixing device for a front panel.
Figure 8:
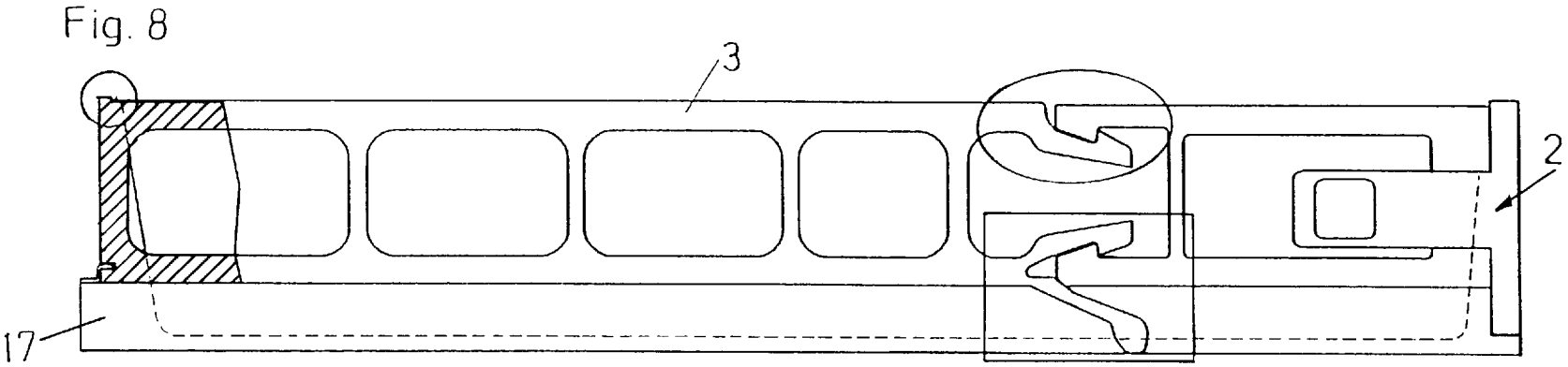
FIG. 8 is a side view of a profile element.
Figure 8C:
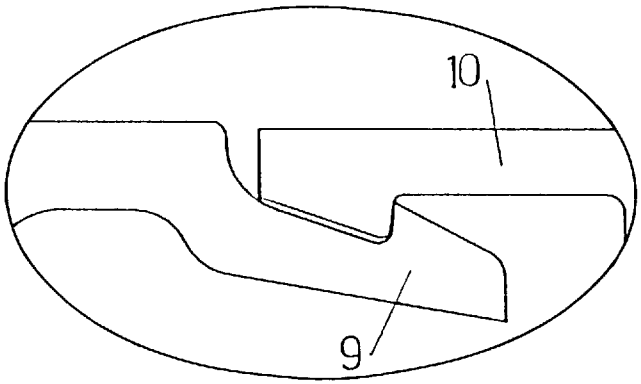
FIGS. 8*a*–8*c* are enlarged views of high-lighted portions of FIG. 8, FIGS. 9 and 10 are cross sections through a drawer frame member and rear subelement.
Figure 8B:
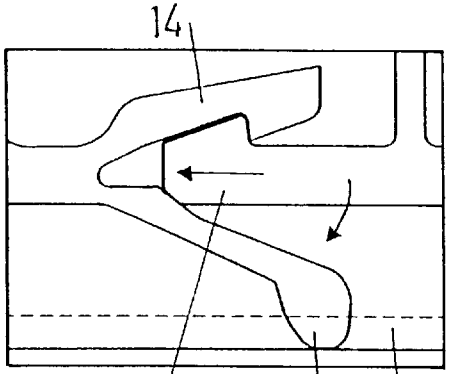
Figure 8A:
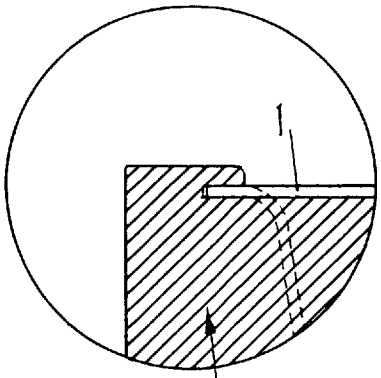
Figures 9, 10, 11A, 11B, 12A, 12B:
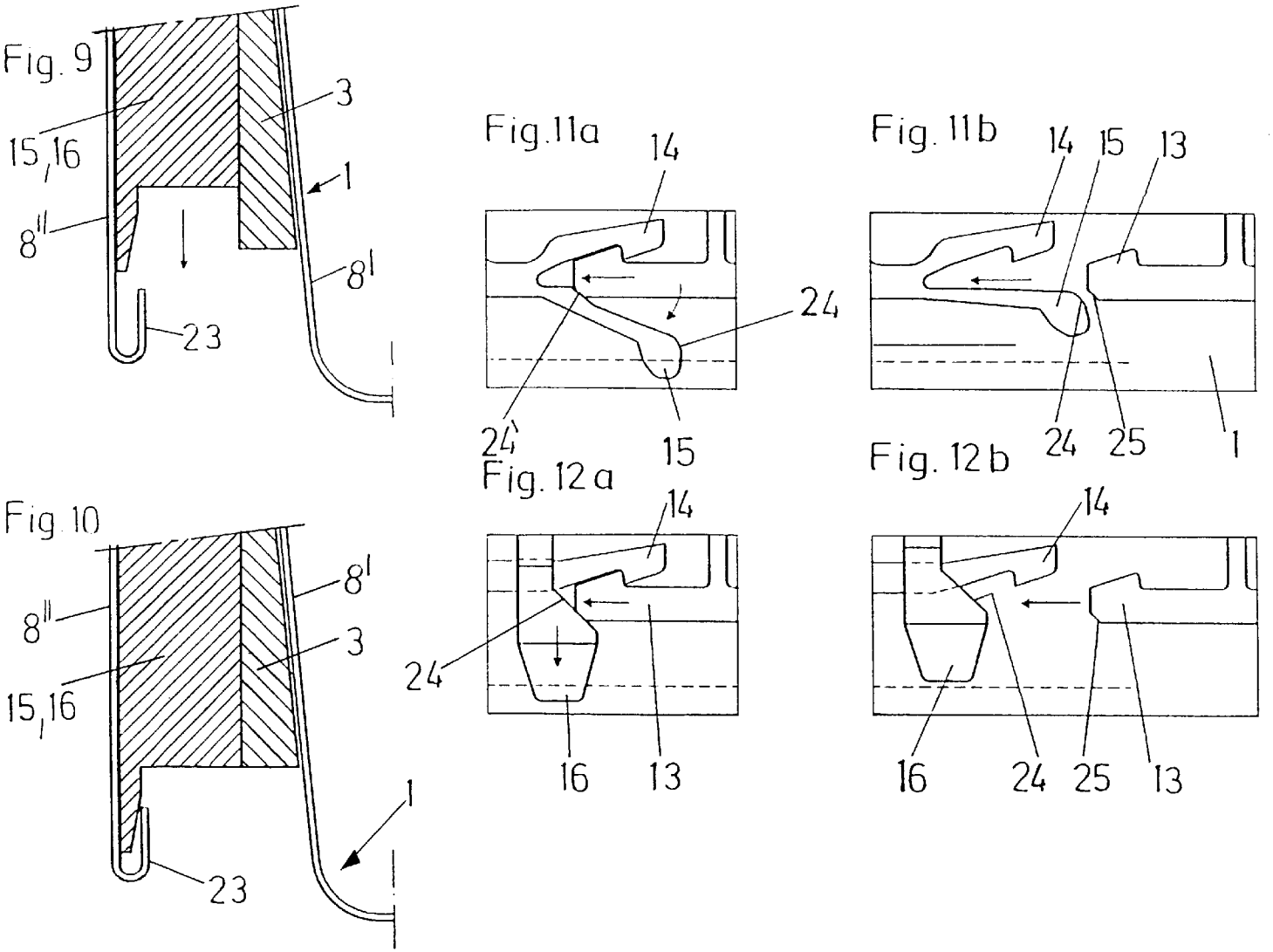

In the exemplary embodiment shown in FIGS. 5 and 6, the outer walls 8" of the drawer frame members 8 are detachable and may be clipped onto the subelements 2, 3.

Figure 4:
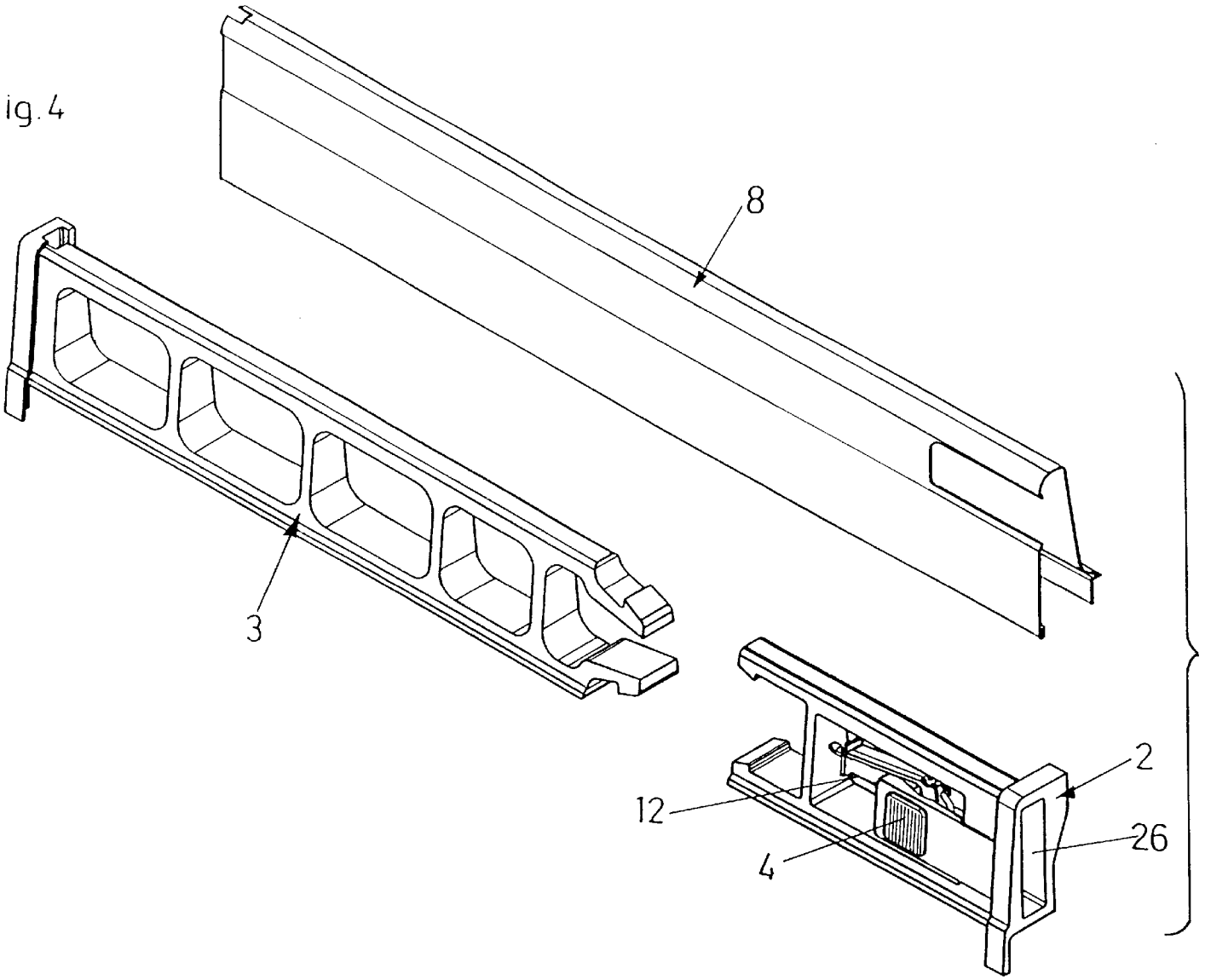
FIG. 4 is an exploded perspective view of an individual drawer frame member and two subelements.

While the means according to the invention for stiffening the drawer frame member 8 is used in particular for drawers with a trough 1, it is perfectly possible, however, to stiffen separate drawer frame members 8, as shown in FIG. 4, with the subelements 2, 3 according to the invention.

In the exemplary embodiments according to FIGS. 14 to 19, the profile elements 30 are of one-piece construction. In both exemplary embodiments, they have cover plates 19 at their front ends, which cover plates 19 adjoin the drawer frame members 8 at the ends thereof. Each cover plate 19 is in turn provided, at the their side facing the drawer frame member 8, with a groove 21 in which the end of the respective drawer frame member 8 is accommodated.

Figures 14, 14A, 14B, 15, 15A, 16:
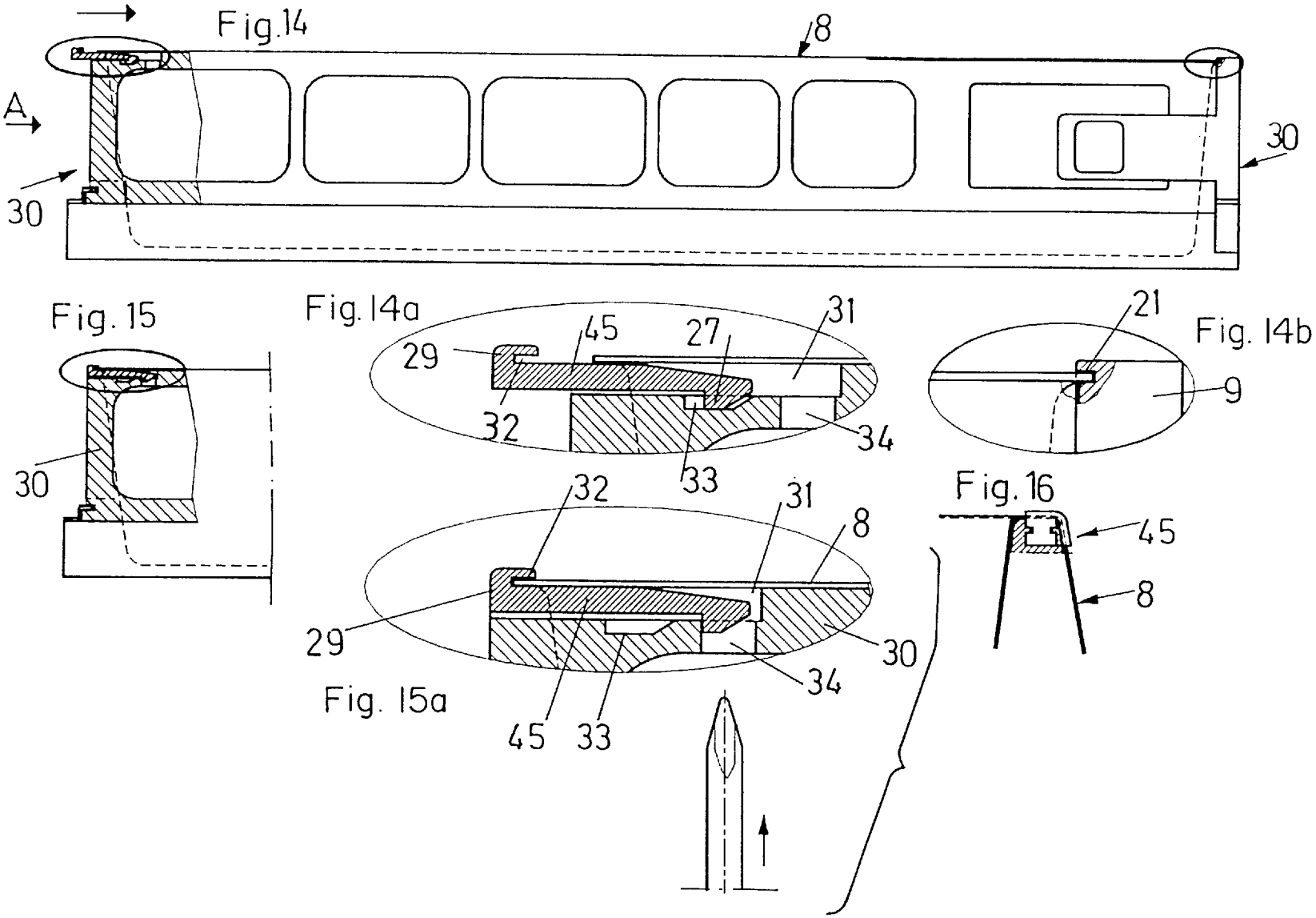
FIG. 14 is a partially sectional side view of another exemplary embodiment of a drawer according to the invention.
FIGS. 14*a*–14*b* are enlarged sections of high-lighted portions thereof.
FIG. 15 is a partially sectional side view of the rear end of a drawer according to the invention.
FIG. 15*a* is an enlarged section of a high-lighted portion thereof.
FIG. 16 is a schematic end view of the rear end of the drawer frame member.

At their rear ends, the profile elements 30 of the exemplary embodiment according to FIGS. 14 to 16 have a recess 31 open at the rear and the top. When the drawer is in the assembled state, a wedge-shaped slide 45 is inserted into this recess 31, which slide 45 has a hook 27 at its front end and a cap 29 with a slot 32 at its rear end. The cap 29 surrounds the cuter rear end of the drawer frame member 8 in the assembled position (FIGS. 15*a*, 16).

Below the recess 31, the profile element 30 has a smaller recess 33 and a hole 34. Prior to final fixing of the profile element 30 in the drawer frame member 8, the slide 45 engages with its hook 27 in the recess 33 (FIG. 14*a*). To fix the profile element 30 in the drawer frame member, the slide 45 is pushed forwards, i.e. into the drawer frame member 8, until its hook 27 engages in the hole 34 in the profile element. The profile element 30 is thus fixed in the drawer frame member 8 at the front by means of the cover plate 19 and the groove 21 and at the rear by means of the slide 45.

Figures 17, 17A, 17B, 18, 18A, 19:
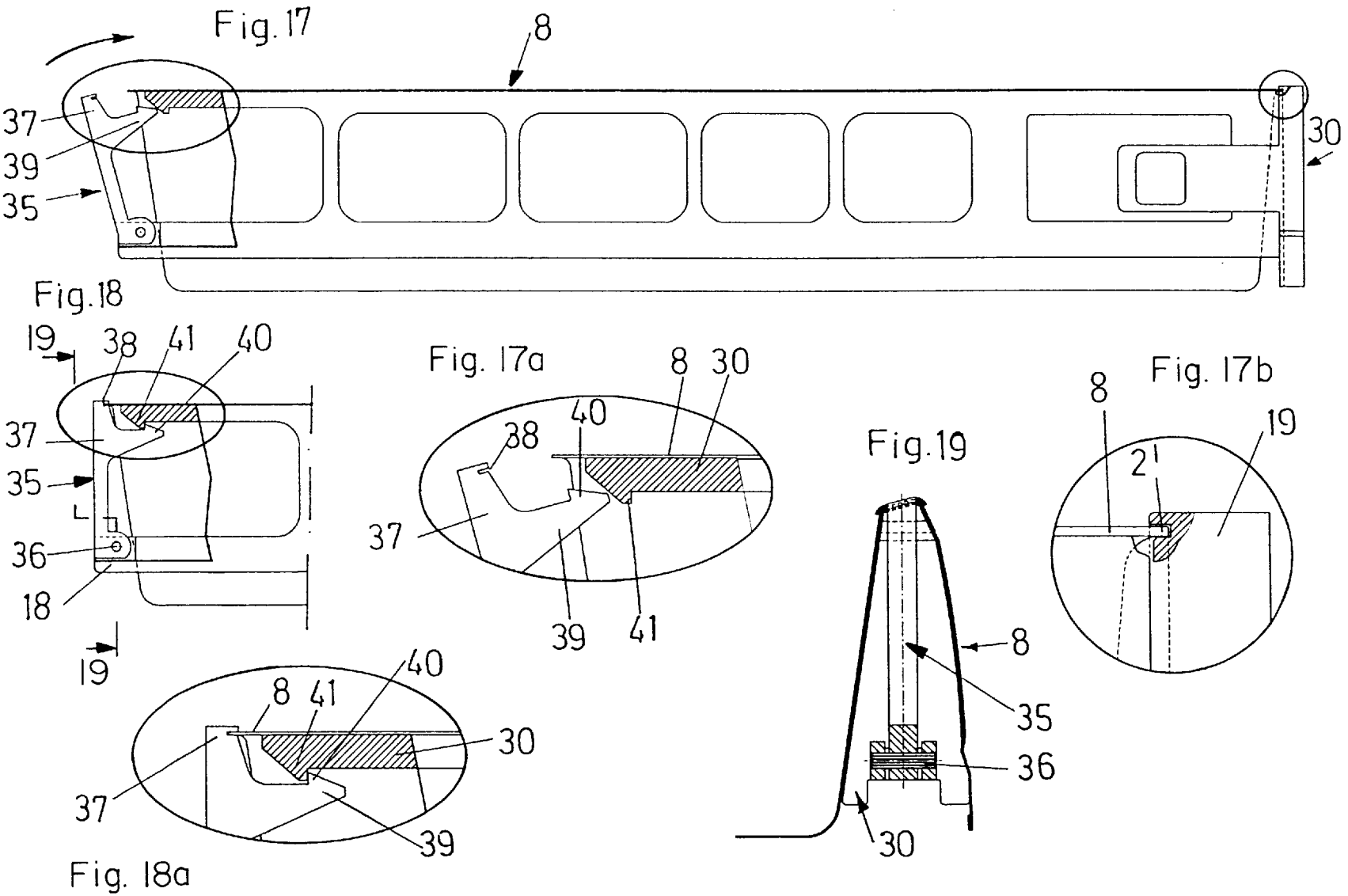
FIGS. 17–18*a* are similar views to FIGS. 14–15*a* but of a drawer according to another exemplary embodiment of the invention.
FIG. 19 is a cross section through a drawer frame member and the profile element, generally along line 19—19 of FIG. 17.

In the exemplary embodiment according to FIGS. 17 to 19, the profile element 30 s provided at its rear end with a cap or projection 18, on which a rocker 35 is mounted by means of a shaft 36. The rocker 35 has an upwardly directed arm 37, which is provided at its free end with a slot 38, which corresponds to the groove 32 in the slide 25. In the assembled position, the rear end of the drawer frame member 8 projects into this slot 38, such that the drawer frame member 8 is held form-fittingly by the rocker 35.

An arm 39 provided with a hook 40 projects from the arm 37. In the assembled position, the hook 40 engages behind a projection 41 on the profile element 30 in the manner of spring-loaded catch, such that the rocker 35 is locked in the position in which it holds the drawer frame member 8 against the profile element 30 or the profile element 30 against the drawer frame member 8.

We claim the following:

1. A drawer comprising:

two double-walled frame members;

two profile elements formed of plastic material, each said profile element being fitted within a respective said frame member and extending over the entire length thereof, each said profile element comprising separate front and rear subelements that can be coupled together;

each said front subelement having a front cover plate adjoining a front end of said respective frame member; and each said rear subelement having a rear cover plate forming a retaining element engaging with said respective frame member and connecting said each profile element to said respective frame member.

2. A drawer as claimed in claim 1, wherein each said profile element has braces matching a cross-sectional configuration of said respective frame member and stiffening said respective frame member.

3. A drawer as claimed in claim 1, wherein said front cover plate and said rear cover plate have grooves into which extend front and rear ends, respectively, of said respective frame member.

4. A drawer as claimed in claim 1, wherein said front subelement has structure at a front end thereof for mounting of a front panel of said drawer.

5. A drawer as claimed in claim 4, wherein said structure comprises an opening to receive an anchor device to be connected to the front panel.

6. A drawer as claimed in claim 1, wherein said rear subelement has at an upper portion thereof a structure to connect to an elevated rear wall section of said drawer.

7. A drawer as claimed in claim 6, wherein said structure comprises an upwardly facing opening to receive a retaining pin of the elevated rear wall section.

8. A drawer as claimed in claim 1, wherein said front and rear subelements have respective coupling structure to engage to couple said front and rear subelements.

9. A drawer as claimed in claim 8, wherein said coupling structure comprises respective inter-engagable hooks.

10. A drawer as claimed in claim 9, wherein said hooks comprise at least one hook on a rear end of said front subelement and at least one hook on a front end of said rear subelement.

11. A drawer as claimed in claim 9, wherein each of said subelements has two said hooks oriented in opposite directions.

12. A drawer as claimed in claim 11, wherein said two hooks are spaced vertically.

13. A drawer as claimed in claim 9, wherein at least one said hook is of resilient construction.

14. A drawer as claimed in claim 1, wherein a first said subelement has an engaging member operable, upon said front and rear subelements being coupled, to engage in a flanged rim of an outer wall of said respective frame member.

15. A drawer as claimed in claim 14, wherein said first subelement comprises said rear subelement.

16. A drawer as claimed in claim 14, wherein said engaging member comprises a slide having a contact surface to be abutted by a second said subelement upon said front and rear subelements being coupled.

17. A drawer as claimed in claim 14, wherein said engaging member comprises a pivotable lever having a contact surface to be abutted by a second said subelement upon said front and rear subelements being coupled.

* * * * *

UNITED STATES PATENT AND TRADEMARK OFFICE

CERTIFICATE OF CORRECTION

PATENT NO. : 6,053,593
DATED : April 25, 2000
INVENTOR(S) : Erich Röck et al.

It is certified that error appears in the above-identified patent and that said Letters Patent is hereby corrected as shown below:

Title page,
Item [73], change "Höchst, Australia" to -- Höchst, Austria --.

Signed and Sealed this

Eighteenth Day of June, 2002

*Attest:*

*Attesting Officer*

JAMES E. ROGAN
*Director of the United States Patent and Trademark Office*